United States Patent [19]

Oka et al.

[11] Patent Number: 5,012,285

[45] Date of Patent: Apr. 30, 1991

[54] DEVELOPING APPARATUS INCLUDING A PARTITIONING ARRANGEMENT FOR PARTITIONING THE TONER ACCOMMODATING TANK

[75] Inventors: Tateki Oka; Naoki Toyoshi; Tomoaki Yokoyama; Hiroshi Mizuno; Hiroshi Murasaki; Akihito Ikegawa; Kouichi Etou; Shuichi Nakagawa, all of Osaka, Japan

[73] Assignee: Minolta Camera Kabushiki Kaisha, Osaka, Japan

[21] Appl. No.: 191,122

[22] Filed: May 6, 1988

[30] Foreign Application Priority Data

| | | | |
|---|---|---|---|
| May 8, 1987 | [JP] | Japan | 62-113185 |
| Nov. 19, 1987 | [JP] | Japan | 62-292464 |
| Dec. 29, 1987 | [JP] | Japan | 62-334029 |
| Apr. 30, 1988 | [JP] | Japan | 63-109870 |

[51] Int. Cl.[5] ..... G03G 15/06

[52] U.S. Cl. ..... 355/245; 118/653; 355/260

[58] Field of Search ..... 355/3 DD, 14 D, 245, 355/246, 259, 260; 118/661, 653

[56] References Cited

U.S. PATENT DOCUMENTS

| | | | |
|---|---|---|---|
| 3,881,446 | 5/1975 | Kurita et al. | 118/657 |
| 4,632,535 | 12/1986 | Nagata | 355/259 |
| 4,647,180 | 3/1987 | Watanabe | 355/246 |

FOREIGN PATENT DOCUMENTS

| | | | |
|---|---|---|---|
| 62-31865 | 2/1987 | Japan | 355/245 |
| 0044773 | 2/1987 | Japan | 355/3 DD |
| 0083778 | 4/1987 | Japan | 355/3 DD |

*Primary Examiner*—Fred L. Braun

*Attorney, Agent, or Firm*—Burns, Doane, Swecker & Mathis

[57] ABSTRACT

A developing apparatus includes a photosensitive drum positioned in confronting relation to a developing sleeve. A toner accommodating tank is provided for supplying toner to the developing sleeve. The toner accommodating tank is divided into a small chamber and a supplementary chamber which are separated from one another by a partition which permits toner to be supplied from the supplementary chamber to the small chamber but which prevents the return of toner from the small chamber to the supplementary. A movable shutter selectively permits and prevents toner from being supplied from the supplementary chamber to the small chamber in accordance with operation of the apparatus.

16 Claims, 14 Drawing Sheets

*Fig. 5* (HAVING A PARTITION WALL)
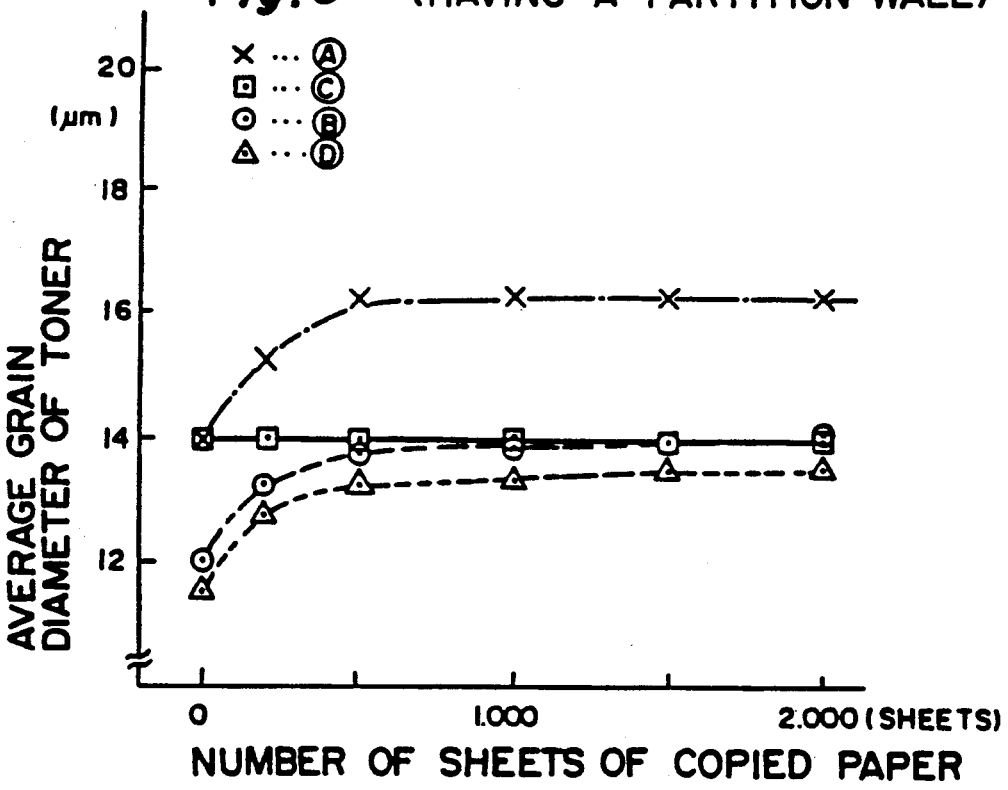
*Fig. 6* (HAVING NO PARTITION WALL)
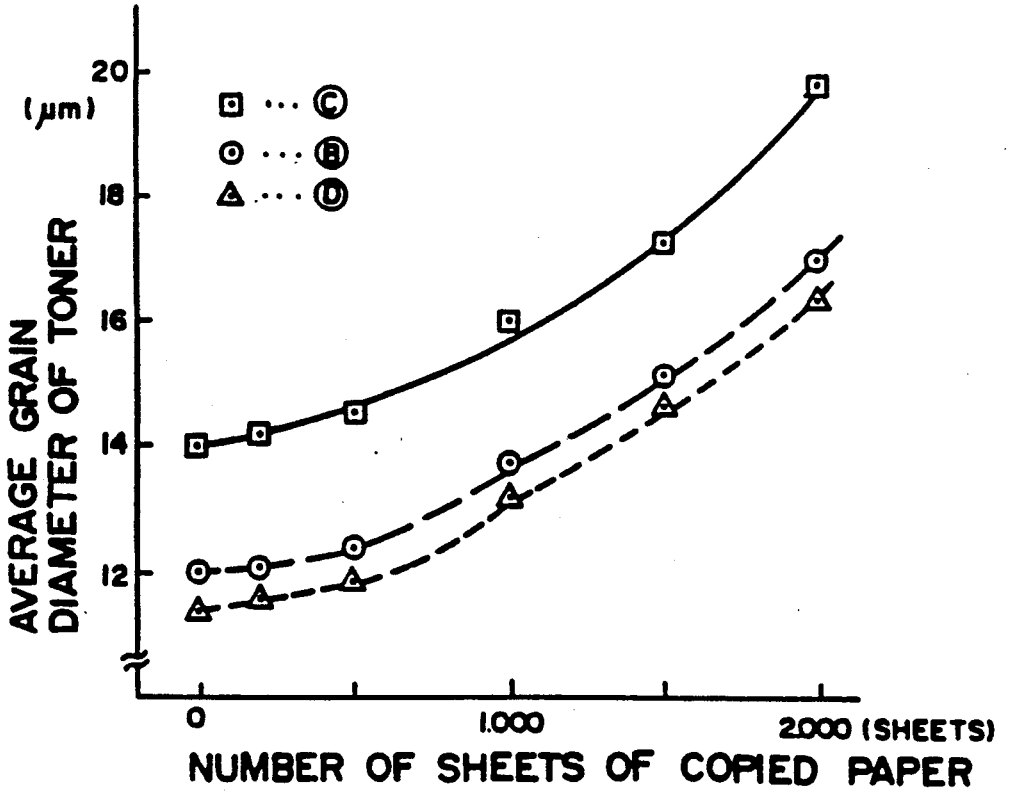

Fig. 13
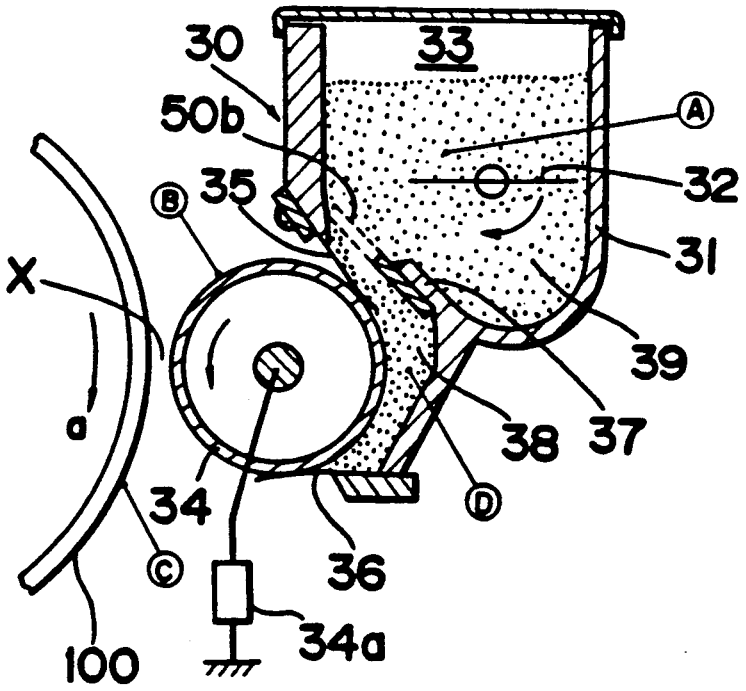
Fig. 14 - CONVENTIONAL
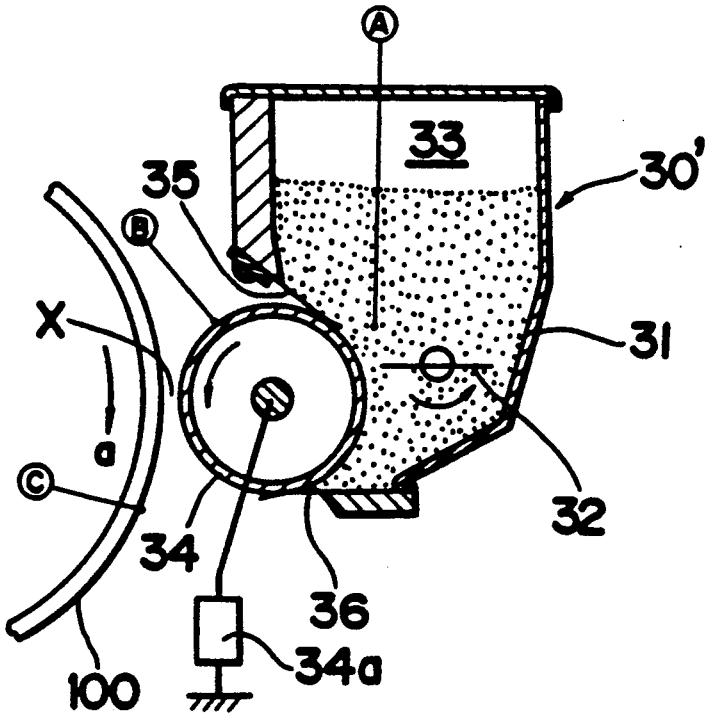

*Fig. 15* (HAVING A PARTITION WALL)
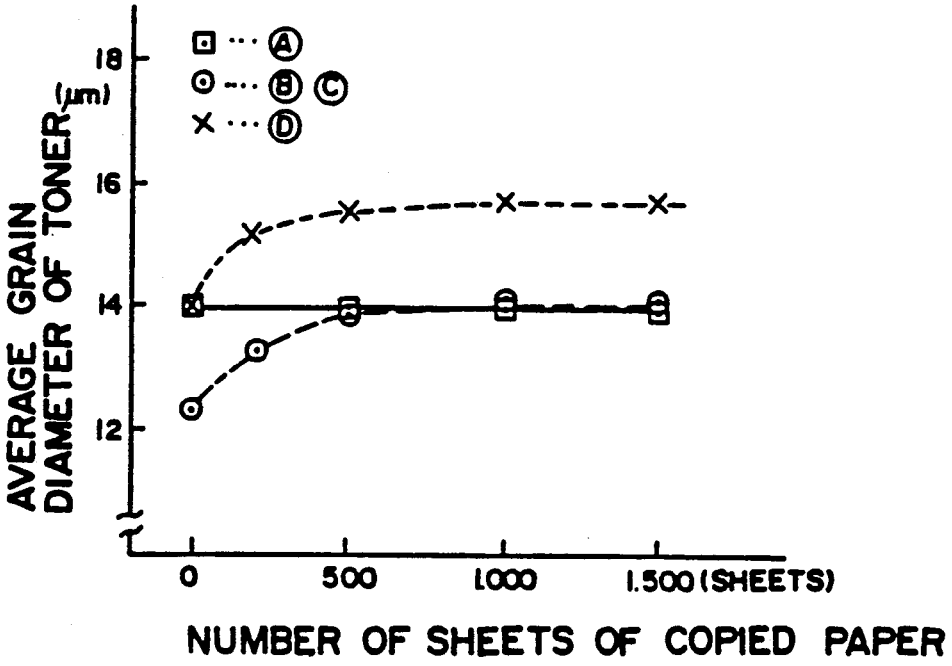
*Fig. 16* (HAVING NO PARTITION WALL)
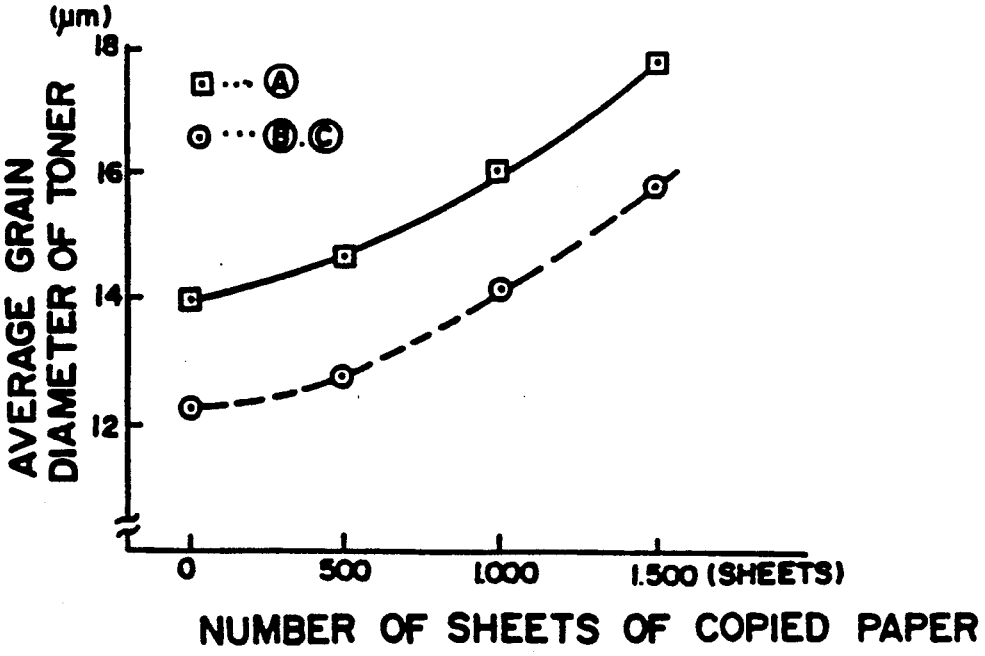

DEVELOPING APPARATUS INCLUDING A PARTITIONING ARRANGEMENT FOR PARTITIONING THE TONER ACCOMMODATING TANK

FIELD OF THE INVENTION

The present invention relates to a developing apparatus being used in an image-forming-apparatus such as a copying machine.

BACKGROUND OF THE INVENTION

Conventionally, as one example of a developing apparatus referred to above, there has been proposed an arrangement as disclosed in Japanese Laid-open Patent Publication No. 119159/1984. That apparatus includes a toner hopper having an agitating member, a roller arranged at an opening of the toner hopper so as to be driven for rotation thereof and a blade contacting the roller under pressure. Toner that is held in the toner hopper is transported based on rotation of said roller while the blade regulates the amount of toner. The roller directly transports toner held on the surface thereof to develop an electrostatic latent image on the surface of a photosensitive member, or after the roller transports the toner to a developing sleeve to be mixed and agitated with carrier, the roller transports it to develop the latent image.

However, in this type of developing apparatus, since after toner is held on the surface of the roller, an excessive amount of the toner is scraped off by the blade, preference is given to toner having a smaller grain diameter in the toner hopper. Thus, toner having a larger grain diameter is scraped off.

Therefore, while the toner is being consumed, some problems arise. Namely, as the residual amount of the toner in the toner hopper decreases, that is, as the number of sheets of copied paper increase, the texture of the image becomes rough, the fog of it produces, and besides spill of the toner increases.

SUMMARY OF THE INVENTION

Accordingly, an essential object of the present invention is to resolve the foregoing disadvantages and to provide a developing apparatus that includes a partition arranged near a toner holding member, such as, for example, the roller, of the toner hopper in the conventional developing apparatus, a small chamber positioned near the toner holding member in the toner hopper, and a supplementary chamber in which is located the agitating member for supplying fresh toner to the small chamber in the toner hopper.

Namely, a preference is given to developing the toner held in the small chamber, and toner scraped off by a regulating member, such as, for example, the blade, is not returned to the supplementary chamber, thus resulting toner supplied to the small chamber is consumed in order that toner having a substantially uniform grain diameter is stably supplied thereto.

Moreover, in another aspect of the present invention, the developing apparatus include a shutter arranged in the toner hopper that is adapted to block communication between the small chamber and the supplementary chamber.

By the above construction, the developing apparatus according to the present invention is provided with the partition arranged in the toner hopper so that based on movement of the toner holding member, toner scraped off the surface of the toner holding member by the regulating member is collected into the small chamber so as not to enter into the supplementary chamber formed behind the partition and so as to supply toner having the same average grain diameter in the small chamber which the toner had when the toner was inserted into the toner hopper.

Therefore, if, in the small chamber, the average grain diameter of the toner becomes bigger, as toner corresponding to the amount of consumed toner and having the average grain diameter is supplied thereto, toner having the average grain diameter is supplied stably for development and thus the fine texture and nonfoginess, that is, good quality, of the image can be obtained.

It is to be noted that when the developing apparatus is removed from a copying machine body in the non-copying operation, or when trouble such as the blockage of a passage with paper is caused, the small chamber is shuttered so as not to connect with the supplementary chamber by the shutter so as to prevent mixing and agitation of the toner held in both chambers. Then, the average grain diameter of toner held in the small chamber can stably maintain a specified value.

BRIEF DESCRIPTION OF THE INVENTION

This and other objects and features of the present invention will become clear from the following description taken in conjunction with the preferred embodiments thereof with reference to the accompanying drawings, in which:

FIGS. 5–7 are graphs illustrating the relation between the number of sheets of copied paper and the average grain diameter of toner;

FIG. 13 is a sectional view of a developing apparatus according to a fifth embodiment of the present invention;

FIG. 14 is a sectional view of a conventional developing apparatus;

FIGS. 15 and 16 are graphs illustrating the relation between the number of copied sheets of paper and the average grain diameter of toner in the developing apparatus shown in the FIGS. 13 and 14;

DETAILED DESCRIPTION OF THE INVENTION

Figure 1:
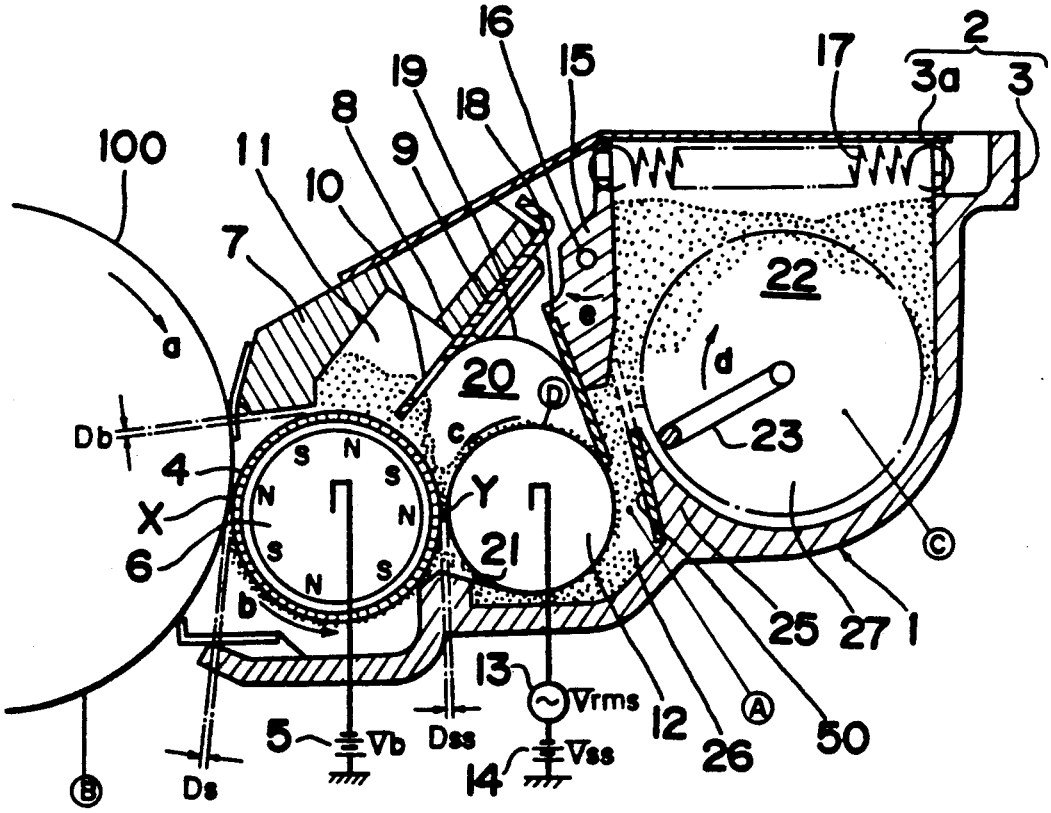
FIG. 1 is a transverse cross-sectional view showing a developing apparatus according to one preferred embodiment of the present invention.

Before the description of the present invention proceeds, it is to be noted that like parts are designated by like reference numerals throughout the accompanying drawings.

FIRST EMBODIMENT

A developing apparatus 1 shown in FIG. 1 is used as an image-forming-apparatus such as a copying machine. The developing apparatus generally includes a developing tank 2 defined by a casing 3 and a cover 3*a*, which comprises a developing sleeve 4 and a toner supplying roller 12, serving as a toner holding member, as shown sequentially toward the right side from the photosensitive drum 100 in FIG. 1, with a toner accommodating tank 22 being further defined at the rear side of the toner supplying roller 12.

In the developing apparatus as described above, the developing sleeve 4 is constructed in the form of a cylindrical body made of electrically conductive non-magnetic material, e.g., aluminum or the like. The surface thereof has plural minute irregularities formed by blasting. The developing sleeve 4 is adapted to be driven for rotation in a counterclockwise direction (i.e., in the direction indicated by an arrow b in FIG. 1) in a position close to the surface of the photosensitive drum 100 driven for rotation in the direction of an arrow a. The developing gap Ds is formed between the developing sleeve 4 and the photosensitive drum 100.

A developing bias supply 5 (developing bias voltage: Vb), supplying direct current, is electrically connected between the developing sleeve 4 and the ground earth. The negative pole of the bias supply 5 is electrically connected to the developing sleeve 4.

A magnetic roller 6 accommodated within the developing sleeve 4 includes a plurality of magnet members having axially extending magnetic poles which are arranged in a circumferential direction so that the magnetic poles N and S are alternately disposed at its outer peripheral portion, and is fixedly provided in a state as shown in FIG. 1.

At the upper portion, near the surface of the photosensitive drum 100, above the developing sleeve 4, a main developer agitating board 7 fixed to the cover 3*a* confronts the surface of the developing sleeve 4 through a predetermined bristle height restricting gap Db between its forward edge and the surface of the developing sleeve 4. At the upper right portion above the developing sleeve 4, a supplementary developer agitating board 9 attached to the support portion 8 of the cover 3*a* confronts the surface of the developing sleeve 4 so that a space chamber 11 is defined above the surface of the developing sleeve 4, by the main developer agitating board 7 and the supplementary developer agitating board 9.

The supplementary developer agitating board 9 has a plurality of slits 10 arranged along the axial direction of the developing sleeve 4.

The toner supplying roller 12 formed by an electrically conductive non-magnetic material, e.g., aluminum or the like, is disposed in a parallel relation at the rear side of the developing sleeve 4 so as to form a supplying gap Dss and to be driven for rotation in the direction of an arrow c. The surface of the supplying roller 12 has plural minute irregularities formed by blasting.

The toner supplying roller 12 is earthed through an AC supply 13 and a DC supply 14 and then a returning bias voltage of biased alternating current is impressed on the toner supplying roller 12.

Moreover, at the upper rear side of the toner supplying roller 12, a blade supporting portion 15 is pivotally connected to a frame for rotation about a shaft 16, with the upper end portion of the blade supporting portion 15 being connected to one end of a spring 17 whose other end is connected to an upper rear end of the developing tank 2 so as to normally urge the blade supporting portion 15 in the direction indicated by an arrow e. By the arrangement, a blade 18, serving as a regulating member, made of steel attached to the lower portion of the blade supporting portion 15 is held in contact with the surface of the toner supplying roller 12 under a light pressure.

The blade 18 is connected to the supplementary developer agitating board 9 by a sheet 19 so that a space chamber 20 is defined above the surface of the toner supplying roller 12, thereby.

Under the toner supplying roller 12, a toner returning prevention film 21 is attached to the casing 3 so as to contact with the surface of the toner supplying roller 12 along its rotating direction.

The toner accommodating tank 22 is formed by partitioning the rear portion of the developing tank 2 by the blade supporting portion 15, the blade 18, the toner supplying roller 12 and the toner returning prevention film 21, and within this toner accommodating tank 22, a partition wall 25 confronting the rear surface of the toner supplying roller 12 is formed by extending upwardly the part of the casing 3. The partition wall 25 partitions the toner accommodating tank 22 into a small chamber 26, serving as a supply chamber, defined by the partition wall 25 and the toner supplying roller 12, and a supplementary chamber 27 located to the rear portion of the partition wall 25. In the supplementary chamber 27, an agitating rod 23 is rotatably provided so as to be driven for rotation in the direction indicated by an arrow d.

Figure 2:
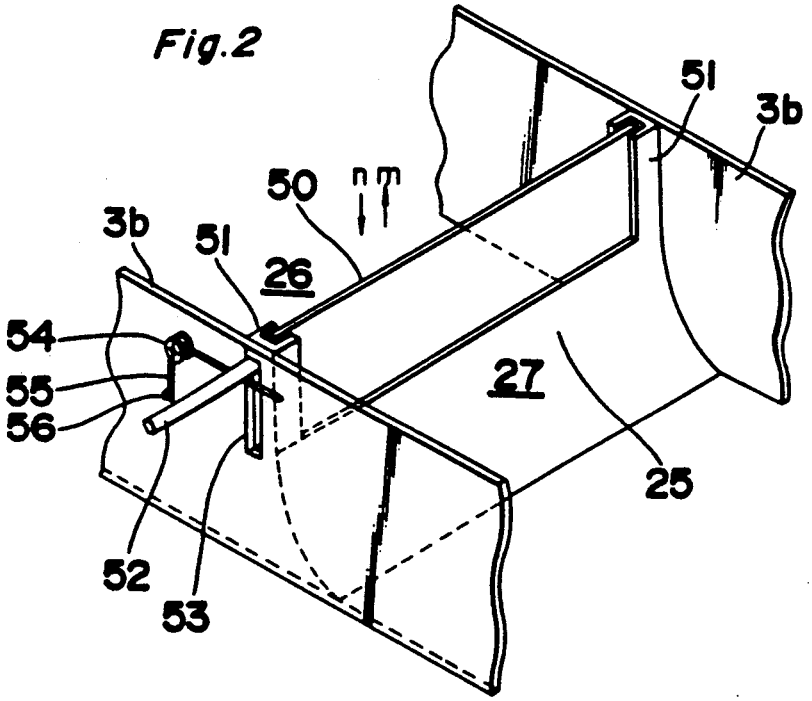
FIG. 2 is a perspective view showing part of the developing apparatus.

A shutter 50 is, preferably, arranged at the front portion of the partition wall 25. The shutter 50, as shown in FIG. 2, is supported movably in the up-and-down direction indicated by arrows m and n, by guide portions 51, 51 formed to confront the inner surface of the casing side wall 3*b*, 3*b*. An actuating member 52 is formed on the one end of the shutter 50. The actuating member 52 is projected from the outside of the casing 3 through an opening guide channel 53 of the casing side wall 3*b*. A coil spring 55 is fixed on the outer surface of the casing side wall 3*b* to be driven for rotation round the support point 54. One end of the coil spring 55 is connected to a stopper 56 arranged at the casing side wall 3*b* and the other end of the spring 55 is connected to the actuating member 52 so as to normally urge the actuating member 52 and the shutter 50 in the upper direction indicated by an arrow m.

Figure 3:
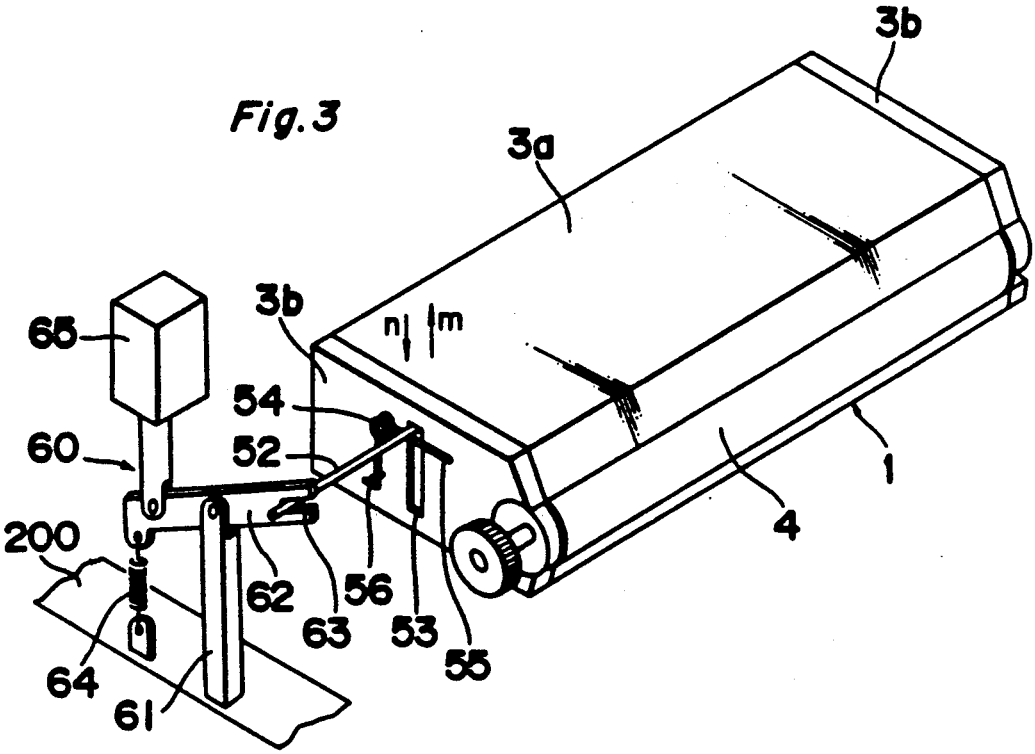
FIG. 3 is a perspective view showing an operating apparatus thereof.

Meanwhile, as shown in FIG. 3, within a copying machine body 200, an operating apparatus 60 is provided at the side of the developing apparatus 1.

In the operating apparatus 60, a base 61 is fixed to the copying machine body 200. An arm 62 is mounted movably on the base 61. A channel 63 is formed at the one end of the arm 62. One end of a spring 64 attached to the copying machine body 200 and a plunger of a solenoid 65 are connected to the other end of the arm 62.

The operation of the developing apparatus having the construction as described so far will be explained.

Initially a starter developing material composed of a mixture of negative charged magnetic carrier and positive charged insulative toner is filled in the space chamber 11 located above the developing sleeve 4 and the toner supplying roller 12, while the insulative toner is also charged into the toner accommodating tank 22.

Figure 4:
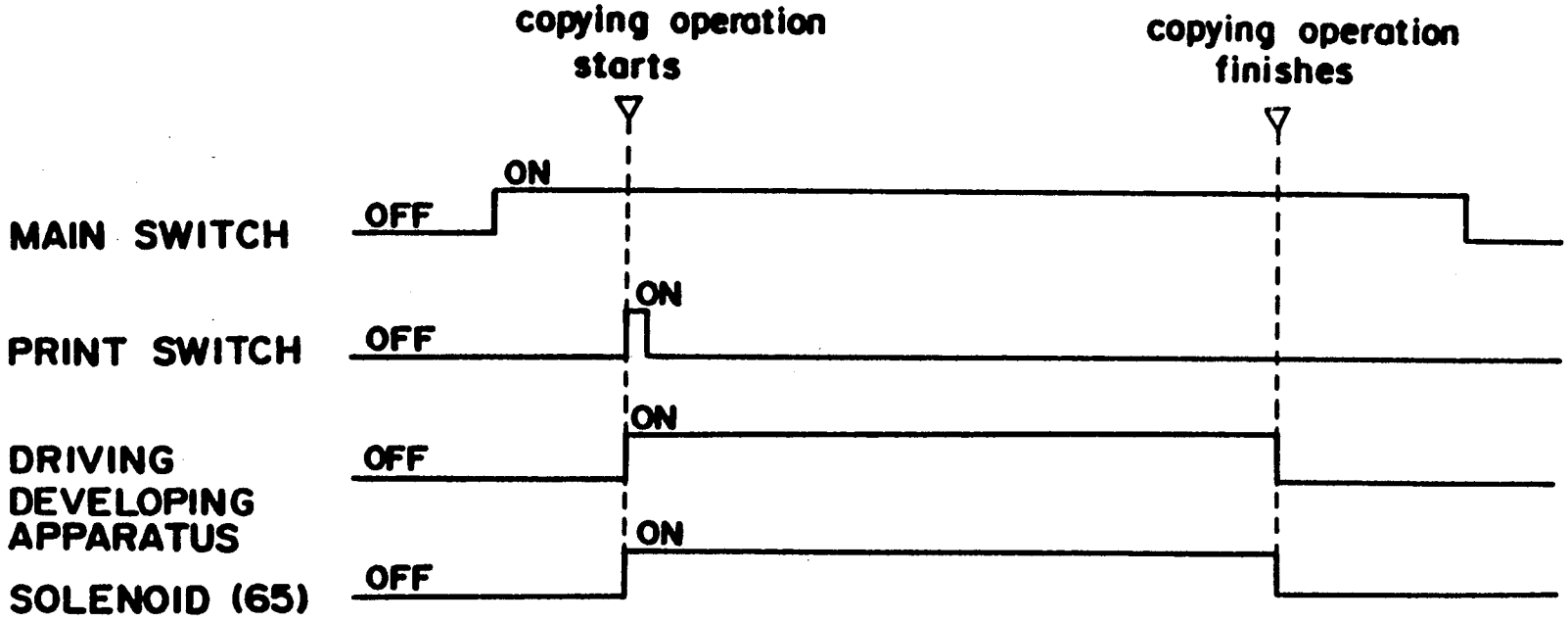
FIG. 4 is a time chart showing operation of the copying machine having the developing apparatus.
Figure 10:
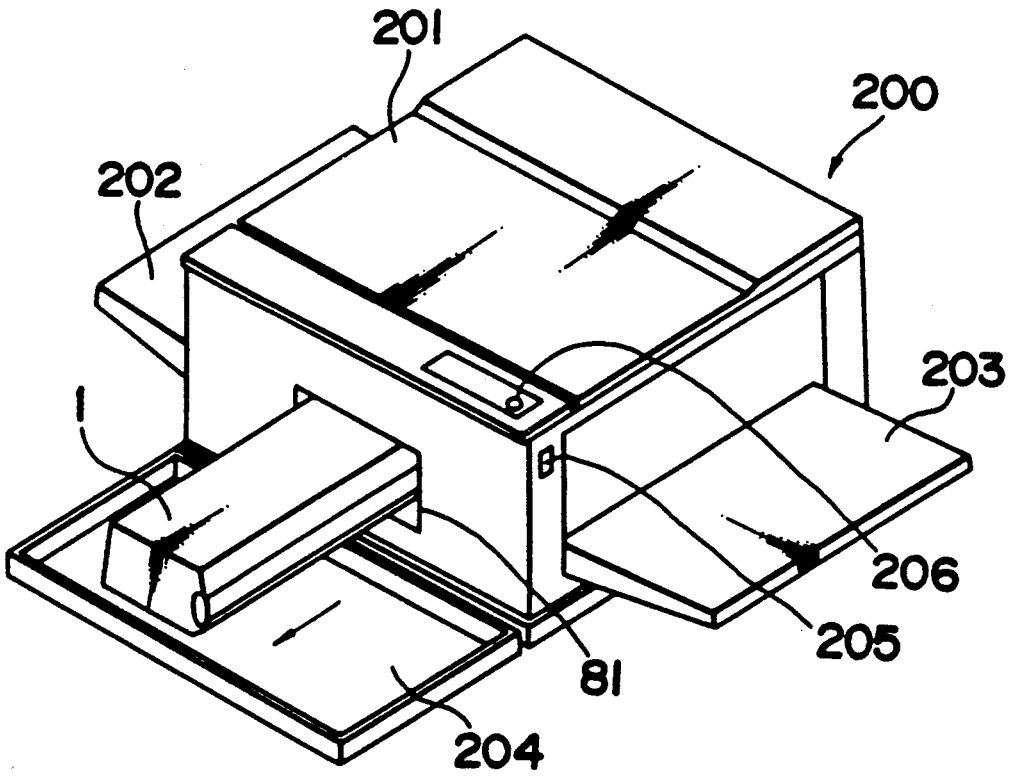
FIG. 10 is a perspective view showing the copying machine according to a third embodiment of the present invention.

In the above state, when the print switch 206 in FIG. 10 is turned on, as shown in the time chart of FIG. 4, the developing apparatus is driven so that the developing sleeve 4, the toner supplying roller 12 and the agitating rod 23 start rotating respectively in the directions as indicated by arrows b, c and d.

When the solenoid 65 is turned on by turning on the print switch 206 as shown in FIG. 4, the shutter 50 moves downwardly in the direction indicated by an arrow n through downward movement of the arm 62 and the actuating member 52 so as to connect the supply chamber 26 with the supplementary chamber 27 through an upper space above the shutter 50.

By the functioning of the developing apparatus 1 as described above, the toner held in the supply chamber 26 of the toner accommodating tank 22 is taken into the minute irregularities on the surface of the toner supplying roller 12.

The toner supplied onto the surface of the toner supplying roller 12 is transported in the direction indicated by an arrow c, with an excessive amount of the toner being scraped off by the blade 18. The toner passed near the end of the blade 18 is preliminary electrically charged by the friction contact thereof with the blade 18.

The toner passed near the end of the blade 18 is brought into the confronting portion with respect to the developing sleeve 4 (i.e., toner supply region Y). At the toner supply region Y, the toner is supplied onto the developing material held on the surface of the developing sleeve 4, according to the voltage difference between the developing bias voltage and the returning voltage. The excessive amount of the toner on the developing sleeve 4 is scraped off so as to collect onto the toner supplying roller 12.

The toner supplied onto the developing sleeve 4 is transported in the direction of the arrow b together with the carrier held on the peripheral surface of the sleeve 4, and most of the developing material is blocked by the supplementary developer agitating board 9.

The developing material is raised along the board 9 by the pressing force of the developing material supplied later. The developing material then passes through the slit 10 and is brought into the downstream space chamber 11. The remainder thereof passes through the gap between the supplementary developer agitating board 9 and the developing sleeve 4 so as to be brought into the downstream space chamber 11.

The developing material supplied into the chamber 11 is blocked by the main developer agitating board 7 and is raised along the board 7 to move downwardly and backwardly thereby causing the material to rotate in the clockwise direction in the chamber 11. Thus, the material joins the developing material passed through the slit 10 so as to be mixed and agitated with it.

Then, part of the developing material sufficiently mixed and agitated passes through the bristle height restricting gap Db between the main developer agitating board 7 and the developing sleeve 4 to form the magnetic brush before the part of the material rubs against the surface of the photosensitive drum 100 at the developing region X for developing the electrostatic latent image formed thereon into a visible image.

After passing through the developing region X, the developing material remaining on the peripheral surface of the developing sleeve 4 is successively transported in the direction of the arrow b based on the rotation of the developing sleeve 4, and upon arrival at the toner supply region Y where the developing sleeve 4 confronts the toner supplying roller 12 fresh toner, corresponding to the amount of consumed toner, supplied from the toner supplying roller 12 is replenished thereto.

After the toner supplied onto the surface of the developing sleeve 4 arrives at the space chamber 20 and 11, the toner is sufficiently mixed and agitated therein. The toner sufficiently mixed and agitated is uniformly fed onto the surface of the sleeve 4, and the previous history of the consuming pattern for the toner used in the last development is erased.

On the other hand, the toner collected on the toner supplying roller 12 enters the minute regularities thereof, and passes through the space with respect to the toner returning prevention film 21 so as to be collected in the toner accommodating tank 22. The toner corresponding to the amount consumed during development is supplied on the surface of the toner supplying roller 12.

Next, when the driving of the developing apparatus 1 is stopped after the copying operating is finished, the solenoid 65 turns off, as shown in the time chart of FIG. 4, and the shutter 50 moves upwardly in the direction indicated by the arrow m so as not to connect the supply chamber 26 with the supplementary chamber 27.

The solenoid 65 can turn off, for example, when trouble arises during a copying operation such as blockage of a passage with paper or when it is possible for the developing apparatus 1 to be tilted.

The developing movement is carried out as described above and thus in the toner accommodating tank 22, the toner held in the supply chamber 26 is gradually consumed.

However, there is a high probability that the toner having smaller grain diameter than that having bigger grain diameter in the toner accommodating tank 22 enters into the minute irregularities on the surface of the toner supplying roller 12. There is also a high probability that when the toner taken into the minute irregularities on the surface of the toner supplying roller 12 passes near the end of the blade 18, the toner having bigger grain diameter than that having smaller grain diameter is scraped off by the blade 18. Thus, the toner having smaller grain diameter than that having bigger grain diameter in the toner accommodating tank 22 is initially consumed while at the same time, the average grain diameter of the toner held in the supply chamber 26 gradually becomes bigger.

However, according to the developing apparatus 1 of the present invention, the space in the toner accommodating tank 22 is partitioned into the supply chamber 26 and the supplementary chamber 27 which is located to the rear side of the chamber 26. Fresh toner, corresponding to the amount of toner consumed in the supply chamber 26, is supplied from the supplementary chamber 27, based on the rotation of the agitating member 23. The fresh toner has an average grain diameter (referred to as "insert average grain diameter" hereinafter) that is similar to the grain diameter which the toner had when the toner was inserted into the toner accommodating tank 22.

Therefore, as described in the following experiment 1, development is repeatedly carried out while fresh toner is supplied into the vacant toner accommodating tank 22, so that during the first step when the toner having smaller grain diameter is initially consumed, the average grain diameter of the toner gradually becomes bigger. After the average grain diameter thereof in the chamber 26 reaches the specified value, the average grain diameter thereof is gradually stabilized so as not to change rapidly, and after that, toner having the specified grain diameter is supplied therein.

Furthermore, when the copying operation is finished and the developing apparatus 1 is taken out from the copying machine body or when trouble occurs such as, for example, happens when the paper causes a blockage, the shutter 50 is driven so as not to connect the supply chamber 26 with the supplementary chamber 27. Then, it should be noted that the toner grain diameter of the toner in the supply chamber 26 can be maintained in a stable state. As described in the following experiment 2, it should be noted that once the average grain diameter of toner in the supply chamber 26 is stable, the diameter thereof will not change and consequently, poor quality of the developed image will not occur.

It is to be noted that although the above embodiment has been mainly described with reference to the developing apparatus 1 providing with the shutter 50, the actuating member 52 and the operating apparatus 60, the present invention is not limited in the embodiment, but can be readily applied to a developing apparatus without those members.

EXPERIMENT 1

Next, the measurement of the average grain diameter of toner at the following measured points is carried out in the developing apparatus 1 according to the present invention as well as in a developing apparatus which does not include the partition wall 25 and the shutter 50, under the following experimental conditions, and the results shown in FIGS. 5 and 6 are obtained.

MEASURED POINTS measured point A; a point in the supply chamber 26, measured point B; a point on the surface of the photosensitive drum 100 after passing through the developing region X, measured point C; a point in the supplementary chamber 27 (or in the case where no partition wall is present, a point in the toner accommodating tank 22 of the developing apparatus), measured point D; a point on the surface of the toner supplying roller 12 after passing near the blade 18,

| Experimental conditions | |
|---|---|
| a. Developing sleeve 4 | |
| Diameter | 24.5 mm |
| Rotating speed | 200 rpm |
| Developing bias voltage Vb | DC-200 V |
| b. Toner supplying roller 12 | |
| Diameter | 20 mm |
| Rotating speed | 200 rpm |
| Returning bias voltage Vss | DC-400 V |
| AC 700 Vrms | |
| AC frequency | 300 Hz |
| Surface roughness | 40 μm |
| c. Gap | |
| The developing gap Ds | 0.6 mm |
| The predetermined bristle height restricting gap Db | 0.45 mm |
| The supplying gap Dss | 0.8 mm |
| d. Blade 18 (stainless blade) | |
| Thickness | t = 100 μm |
| Pressure | 0.1 g/mm |
| e. Toner | |
| Insert average grain diameter | 14 μm |

As is clear from the drawing in FIG. 5, in the developing apparatus 1 having the partition wall 25, the toner average grain diameter measured at the measured point C in the supplementary chamber 27 maintains the value of the toner insert average grain diameter at 14 μm which corresponds to the average grain diameter that the toner fresh toner had when it was inserted into the toner accommodating tank 22, regardless of the number of sheets of copy paper that have been copied.

The toner average grain diameter measured at the measured point A in the supply chamber 26 becomes bigger and bigger until the number of sheets of copy paper copied is about 500. After the number thereof is about 500, the value of the toner average grain diameter is maintained at a substantially constant value of about 16 μm. Furthermore, though, at the first step, the toner average grain diameter measured at the measured point B on the photosensitive drum 100 and at the measure point D on the toner supplying roller 12 is small and the toner having a smaller grain diameter is preferred, the average grain diameter thereof measured at the measured point A in the supply chamber 26 stops tending to become bigger and the diameter becomes stable. When the diameter measured at the measured point B becomes 14 μm, that is, the insert average grain diameter, the diameter becomes stable. When the diameter thereof measured at the measured point D becomes 13.5 μm, the diameter is stable .

Thus, although, in the developing apparatus 1 according to the present invention, by repeating the copying operation, the average grain diameter of toner in the supply chamber 26 becomes bigger than the insert average grain diameter of 14 μm, the actual average grain diameter of toner used in developing is the insert average grain diameter thereof, and thus the toner supplied into the toner accommodating tank 22 itself is in essence supplied thereto.

Meanwhile, in the developing apparatus which does not include a partition wall 25, as shown in FIG. 6, the average grain diameter of toner measured at the measured point C in the toner accommodating tank 22 becomes bigger and bigger as the number of sheets of copy paper copied increases, and the average grain diameter thereof reaches about 20 μm when the number grain diameter thereof reaches about 20 μm when the number thereof reaches 2000.

Since, at the measured points B and D, the toner having smaller grain diameter is preferentially supplied from the toner accommodating tank 22 thereto, at the first step, the average grain diameter thereof is smaller than the toner insert average grain diameter 14 μm. However, after that, the diameter gradually becomes bigger and bigger, and when the number of sheets of the copied paper reaches about 1300–1400, the diameter thereof is bigger than 14 μm. When the number of sheets of the copied paper reaches 2000, the diameter thereof is more than 16 μm. It was confirmed that when the number thereof is more than a specified value, the developed image becomes foggy and the texture of the image becomes rough.

EXPERIMENT 2

In experiment 2, after the copying operation is carried out to use 1000 sheets of the copying paper under the same experimental conditions as experiment I, the developing apparatus 1 is tilted to mix and to agitate toner in the supply chamber 26 and toner in the supplementary chamber 27. In this mixed and agitated state, the copying operation is started again, and the measurement of the change of the average grain diameter of toner is carried out at the measured points A, B and C, respectively.

Figure 7:
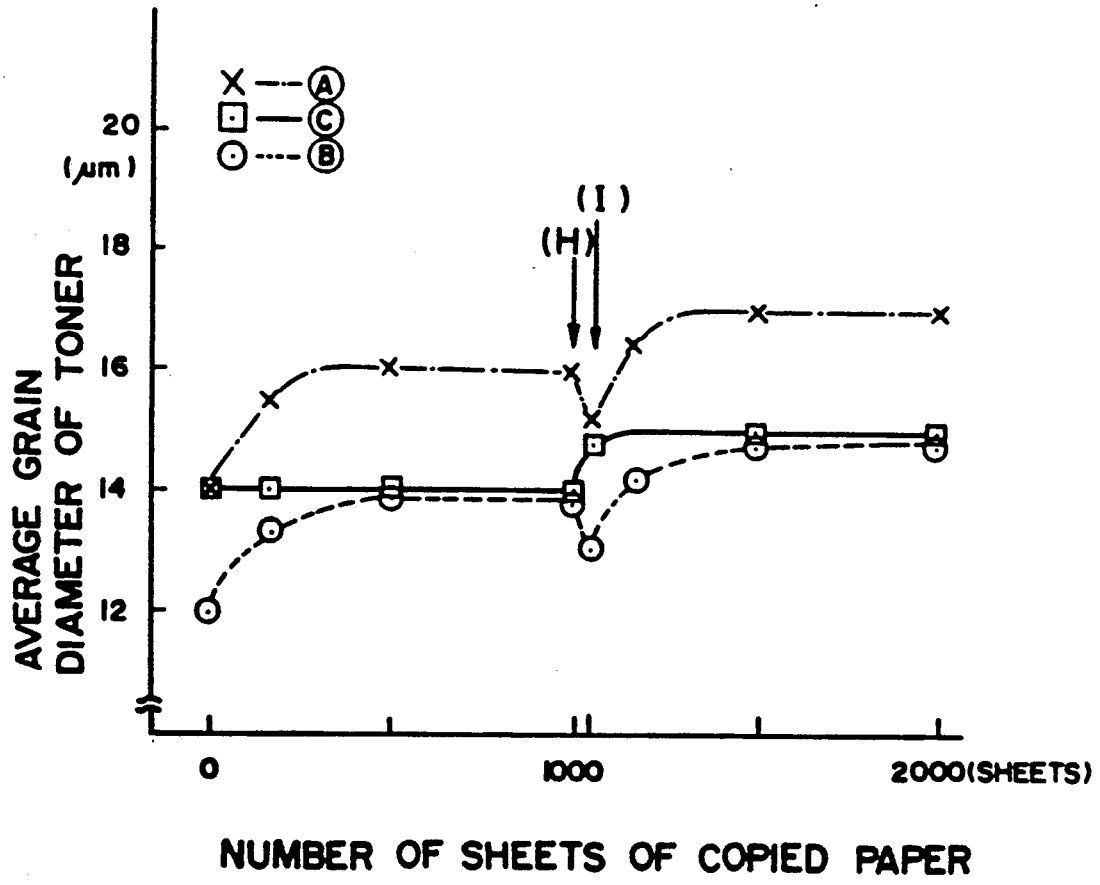

The results shown in FIG. 7 are obtained from the measurement. As shown in FIG. 7 at the finish point (H) when the copying operation is finished after copying 1000 sheets, the average grain diameter of toner measured at the points A, B and C is stable, and the diameter changes are as follows.

The average grain diameter of toner in the supply chamber 26 and the average grain diameter of toner on the surface of the photosensitive drum 100 is reduced to the value indicated by a point (I) in FIG. 7. After that, both diameters become bigger and the diameter of toner in the supply chamber 26 is stabilized at about 17 μm and the diameter of toner on the surface of the photosensitive drum 100 is stabilized at about 15 μm. Meanwhile, since toner that includes a large amount of grain having bigger grain diameter from the supply chamber 26 is inserted into the supplementary chamber 27, the average grain diameter of toner in the supplementary chamber 27 becomes bigger and is stabilized about 14.4 μm.

Then, the texture of the developed image becomes rough and the developed image becomes foggy.

Furthermore, when the number of sheets of the copied paper reaches 2000 (not shown), the developing apparatus 1 is tilted to mix and agitate toner in the supply chamber 26 and toner in the supplementary chamber 27 again. Then, the average grain diameter of toner on the surface of the photosensitive drum 100 and the average grain diameter of toner in the supply chamber 26 become bigger and thus the quality of the developed image is remarkably degraded and the spillage of the toner causes the inside of the developing apparatus to become dirty.

SECOND EMBODIMENT

Figure 8:
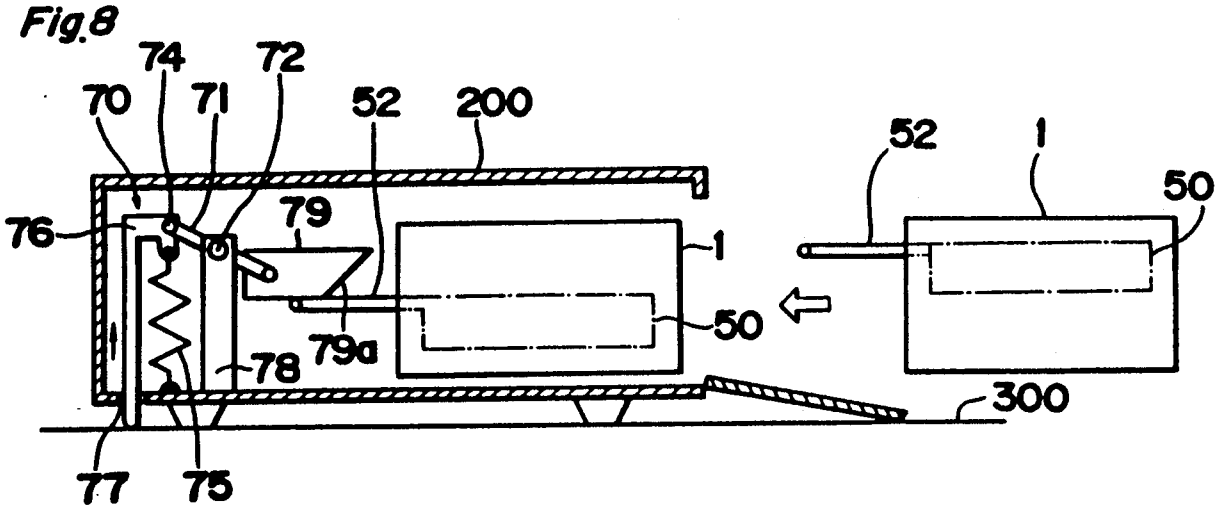
FIGS. 8 and 9 are sectional views of an operating apparatus according to a second embodiment of the present invention.
Figure 9:
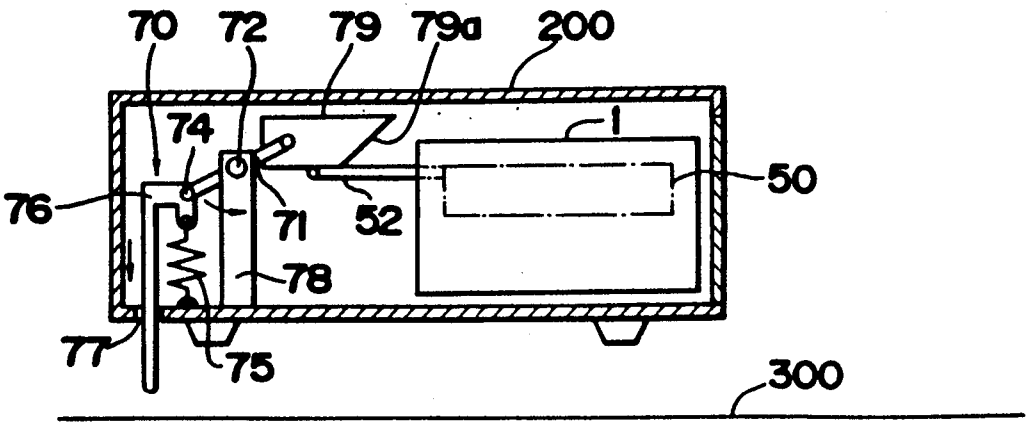

FIGS. 8 and 9 show another embodiment according to the operating apparatus for driving the shutter 50 to move in the up-and-down direction. The construction of the developing apparatus 1 is the same as the apparatus according to the first embodiment except one difference . The difference between the first embodiment and the second embodiment is that the end shape of the actuating member 52 is slightly changed.

In the operating apparatus 70 shown in FIGS. 8 and 9, an arm 71 is supported by a supporting axis 72, as a point of support, on a strut 78 fixed to the bottom portion of the copying machine body 200 to be rotatable around the axis 72. The one end of the arm 71 is supported by a contact portion 79 to be rotatable. The contact portion 79 is supported by a guide member (not shown) to be movable in the up-and-down direction. The other end of the arm 71 is normally urged in the downward direction by a spring 75. The rightward end face **79*a* of the contact portion 79 is leftwardly inclined from top to bottom in FIGS. 8 and 9. The lower end of the spring 75 is connected to the copying machine body 200. A detecting member 76 is arranged to be movable in the forward and backward direction through an opening 77 formed at the bottom surface of the copying machine body 200**.

According to the above construction of the operating apparatus 70, as the developing apparatus 1 is attached to the copying machine body 200, the end of the actuating member 52 contacts the contact portion 79. Then in the state in FIG. 8 in which the copying machine body 200 is mounted on a mounting base 300, the lower portion of the detecting member 76 contacts the mounting base 300 and moves upwardly, and thus the end of the arm 71 moves downwardly with the contact portion 79 against the bias force of the spring 75. Then, as the developing apparatus 1 is inserted into the copying machine body 200, the actuating member 52 and the shutter 50 move downwardly along the rightward surface **79*a* of the contact portion 79 while the member 52 contacts the surface 79*a*, and the supply chamber 26 is connected with the supplementary chamber 27**.

Furthermore, as the copying machine body 200 is lifted up from the mounting base 300, as shown in FIG. 9, the detecting member 76 moves downwardly by the bias force of the spring 75, the arm 71 rotates in the direction indicated by the arrow around the supporting axis 72, and the shutter 50 moves upwardly with the contact portion 79 and the actuating member 52 so as not to connect the supply chamber 26 with the supplementary chamber 27.

THIRD EMBODIMENT

Figure 11:
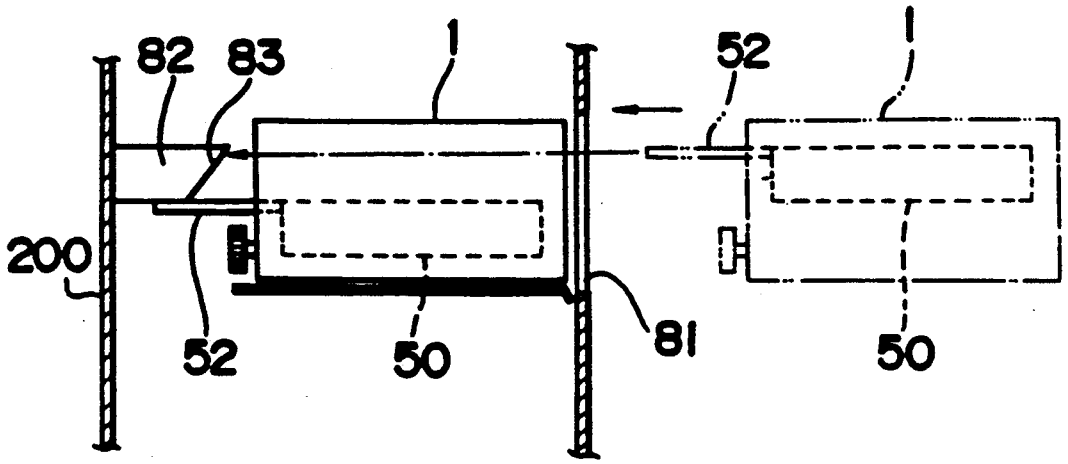
FIG. 11 is a sectional view of an operating apparatus according to third embodiment.

FIGS. 10 and 11 show another embodiment according to the operating apparatus for moving the shutter 50 in the up-and-down direction. A copying machine according to this embodiment is a type in which the developing apparatus 1 is removably inserted into the side of the copying machine body 200 and the developing apparatus 1 has an opening 81 formed to the foreground side surface of the copying machine body 200, the developing apparatus 1 being removably attached thereto through the opening 81. The construction of a developing apparatus 1 according to this embodiment is the same as the above-described first embodiment.

Furthermore, as shown in FIG. 11, a contact portion 82 is formed to the leftward inner surface of the copying machine body 200, and the rightward end surface of the contact portion 82 is leftwardly inclined from top to bottom in FIG. 11.

Therefore, according to the above construction of the operating apparatus, as the developing apparatus 1 is inserted into the body 200 through the opening 81, the actuating member 52 contacts the rightward end face 83 of the contact portion 82. As the apparatus 1 is further inserted into the body 200, the actuating member 52 moves downwardly along the end face 83 of the contact portion 82 while the actuating member 52 contacts the face 83, so that the shutter 50 moves downwardly. Then the supply chamber 26 is connected with the supplementary chamber 27.

As the developing apparatus attached to the body 200 is removed therefrom, the shutter 50 is driven to move upwardly by the bias force of the spring 55 (see FIG. 3) so as not to connect the supply chamber 26 with the supplementary chamber 27.

In the copying machine shown in FIG. 10, reference numeral 201 denotes an operating cover, reference numeral 202 denotes a paper feed cassette, numeral 203 denotes an exhaust paper tray, numeral 204 denotes a front cover, numeral 205 denotes a main switch, and numeral 206 denotes a print switch.

FOURTH EMBODIMENT

Figure 12:
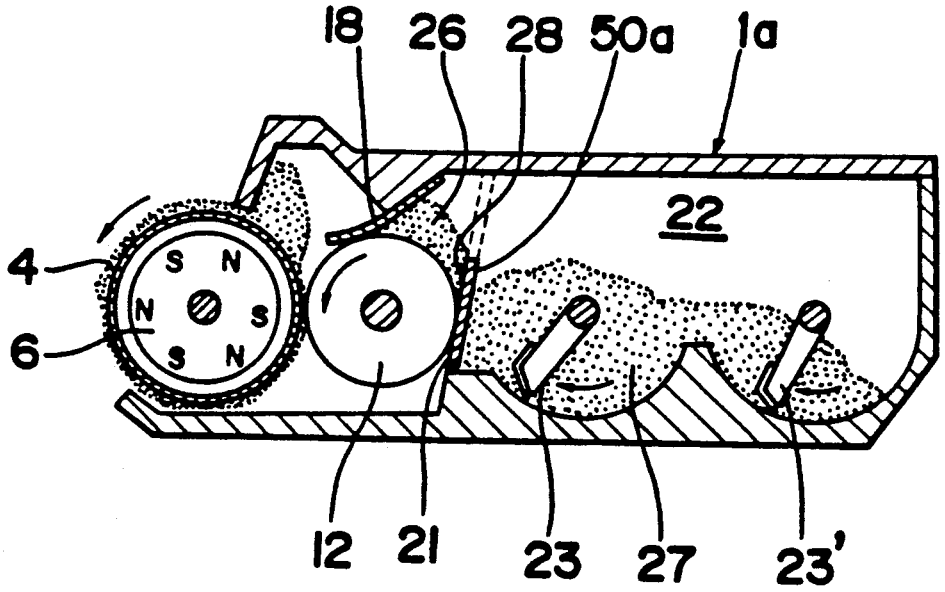
FIG. 12 is a sectional view of a developing apparatus according to a fourth embodiment of the present invention.

In the first embodiment, the steel blade 18 contacts the toner supplying roller 12 under pressure in the direction opposite to the direction of rotation of the roller 12, and the partition wall 25 is formed by extending upwardly the inner surface of the casing 3. It is to be noted that the present invention is not limited to the first embodiment and can be applied to the fourth embodiment shown in FIG. 12.

In this fourth embodiment, a blade 18 made of polyurethane rubber contacts the toner supplying roller 12 under pressure in the direction of rotation of the roller 12 and toner returning prevention film 21 contacts the back surface of the toner supplying roller 12 under pressure while the end portion of the film 21 is extended. Through the above arrangement, the toner returning prevention film 21 serves as the partition wall 28. Furthermore, if necessary, as in the first embodiment, a shutter **50*a* can be arranged behind the partition wall 28 and can operate such that when the developing apparatus 1 is removed from the copying machine body 200, or when trouble such as blockage of the passage with paper is caused, or when the copying machine comes out of a non-copying operation, the supply chamber 26 is shut by the operating apparatus so as not to connect with the supplementary chamber 27**.

Therefore, in this fourth embodiment, toner held in the supply chamber 26 is preferably consumed, and toner, corresponding to the amount of the consumed toner, supplied from the supplementary chamber 27 by an agitating member 23 and 23' is replenished thereto.

Then, as in the first embodiment, since the supply chamber 26 is shut by the shutter **50*a* so as not to connect with the supplementary chamber 27, if the developing apparatus 1 is tilted, the toner held in the supply chamber 26 is not mixed and agitated with the toner held in the supplementary chamber 27**, whereby the insert average grain diameter of toner is stabilized and supplied during development so that fine texture and nonfoginess of the image can be obtained.

FIFTH EMBODIMENT

It should be noted that, although the foregoing first and fourth embodiments have been described with reference to the apparatus employing the two-component developing material composed of toner and carrier, the present invention is not limited in its application to such an apparatus alone, but can be applied to a developing apparatus 30 using a mono-component developing material, as shown in FIG. 13.

In the developing apparatus 30, a developing sleeve 34 having minute irregularities on the surface of the outer peripheral portion thereof is arranged at the opening of a toner hopper 31. A blade 35 contact the upper portion of the peripheral portion of the developing sleeve 34 under pressure and a toner returning prevention film, serving as a seal member 36 contacts the lower portion of the outer peripheral portion of the developing sleeve 34 under pressure.

Within a toner accommodating tank 33 formed in the toner hopper 31, a partition wall 37 confronting the toner supplying roller 34 is formed by extending a part of the lower inner surface of the toner hopper 31 at a suitable place therein. The inner space of toner accommodating tank 33 is partitioned into a small chamber 38, serving as a supply chamber, positioned near the toner supplying roller 34 and a supplementary chamber 39 accommodating an agitating member 32 and positioned therebehind. Both chambers 38, 39 are connected with each other and are adapted to be prevented from communicating with one another by a shutter **50*b*. The shutter 50*b* is moved reversibly from the state described by a solid line to the state described by a dotted line by the above operating apparatus. Developing bias voltage of biased alternating current is impressed on the toner supplying roller 34 from a power supply 34*a***.

According to the construction of the developing apparatus 30, toner taken into the minute irregularities on the surface of the developing sleeve 34 based on rotation of the developing sleeve 34, is spread onto the surface thereof in a thin layer by the blade 35 and an excessive amount of the toner is scraped off by the blade 35 as the toner passes near the confronting portion of the blade 35.

Toner held onto the surface of the developing sleeve 34 is transported to the confronting portion (developing region X) of the photosensitive drum 100 to be used for development. The surface of the developing sleeve 34 passed through the developing region X passes near the end of the toner returning prevention film 36 and enters into the supply chamber 38, and then toner is supplied onto the surface thereof again so that the foregoing operation is carried out.

Meanwhile, as toner held into the supply chamber 38 is consumed, toner, corresponding to the amount of the consumed toner, is supplied thereonto from the supplementary chamber 39 by transportation of the agitating member 32 rotating in the chamber 39.

Therefore, according to the developing apparatus 30, as the developing apparatus 1 which the above-described two-component developing material is used therein, toner held into the supply chamber 38 is preferably consumed in order.

Also, when the developing apparatus 30 is removed from the copying machine body, when the copying machine comes out of a non-copying operation, or when trouble such as the blockage of a passage with paper occurs, since the supply chamber 38 is not connected with the supplementary chamber 39 by the shutter 80, the average grain diameter of toner held in the supply chamber 38 is stable and the uniform quality of the developed image can be maintained.

Next, by using the above-described developing apparatus 30 and a developing apparatus 30' shown in FIG. 14 which has the same kind of configuration as that of the apparatus 30 but which has no partition wall 37, toner having an average grain diameter of 14 μm can be inserted into both apparatus and the measurement of the average grain diameter of toner is carried out, in relation to the number of copied sheets, at the measure point A in the toner accommodating tank 33, the measured point B, located at the foreground of the developing region X, on the surface of the toner supplying roller 34, the measured point C, passed through the developing region X, of the surface of the photosensitive drum 100, and the measured point D of the supply chamber 38 in the developing apparatus 38, respectively.

As shown in FIG. 15 (corresponding to the developing apparatus 30) and FIG. 16 (corresponding to the developing apparatus 30'), the same experimental result as that of the developing apparatus 1 shown in FIG. 1 is obtained.

Namely, in the developing apparatus 30, though the average grain diameter of toner, corresponding to an increase in the number of copied sheets in the supply chamber 38 becomes larger up to a specified value, the average grain diameter of toner supplied for development is maintained at a value similar to the insert average grain diameter of toner inserted into the toner hopper 31.

However, in the developing apparatus 30', the following result is verified by the experiment. Namely, the average grain diameter of toner held in the toner accommodating tank 33, corresponding to an increase in the number of copied sheets becomes bigger to the extent that when the number of sheets of copied paper reaches about 1500, the average grain diameter of toner reaches about 18 μm. Although the average grain diameter of toner supplied for development is initially small, when the number of copied sheets exceeds 1000, the average grain diameter of toner becomes bigger and bigger than 14 μm.

SIXTH EMBODIMENT

Figure 17:
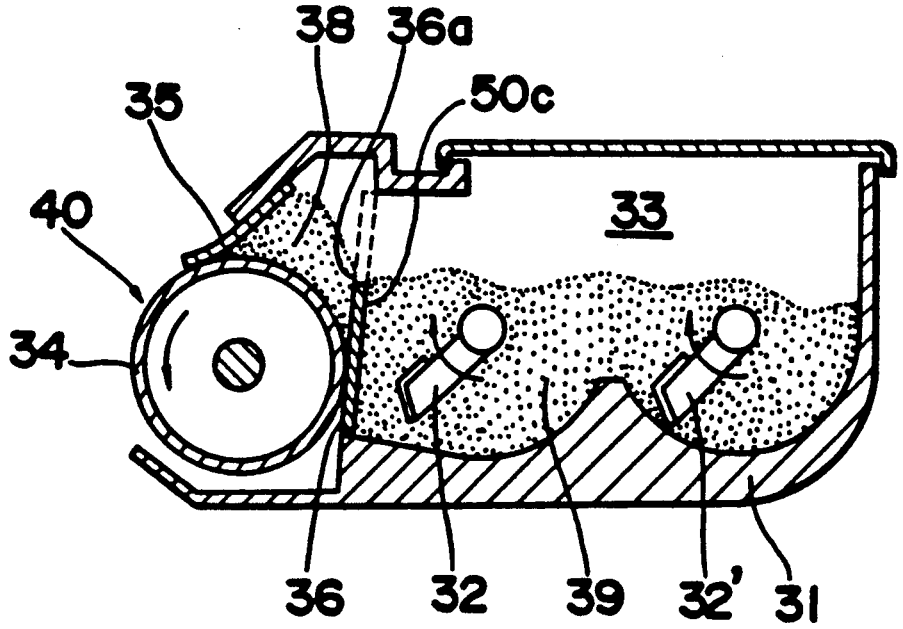
FIG. 17 is a sectional view showing a developing apparatus according to a sixth embodiment of the present invention.

The sixth embodiment shown in FIG. 17 employs a monocomponent developing material as the developing apparatus 30 of the fifth embodiment does. In the sixth embodiment, an elastic member serving as the blade 35 and made of suitable material such as, for example, polyurethane rubber is used. The toner returning prevention film 36 contacts the back of the toner supplying roller 34 under pressure, and the end thereof is extended upwardly to form a partition wall **36*a*. A shutter 50*c* operating by an operating apparatus (not shown) can be provided behind the partition wall 36*a*** as in the foregoing embodiment, if necessary.

In this embodiment, the same function and effect as the foregoing embodiment is obtained.

It is to be noted that although, in the foregoing embodiments, the supplementary chamber 27 and 39 only have the agitating member, the present invention is not limited to the above embodiments and the supply chamber 26 and 38 can have the agitating member.

SEVENTH EMBODIMENT

Figure 18:
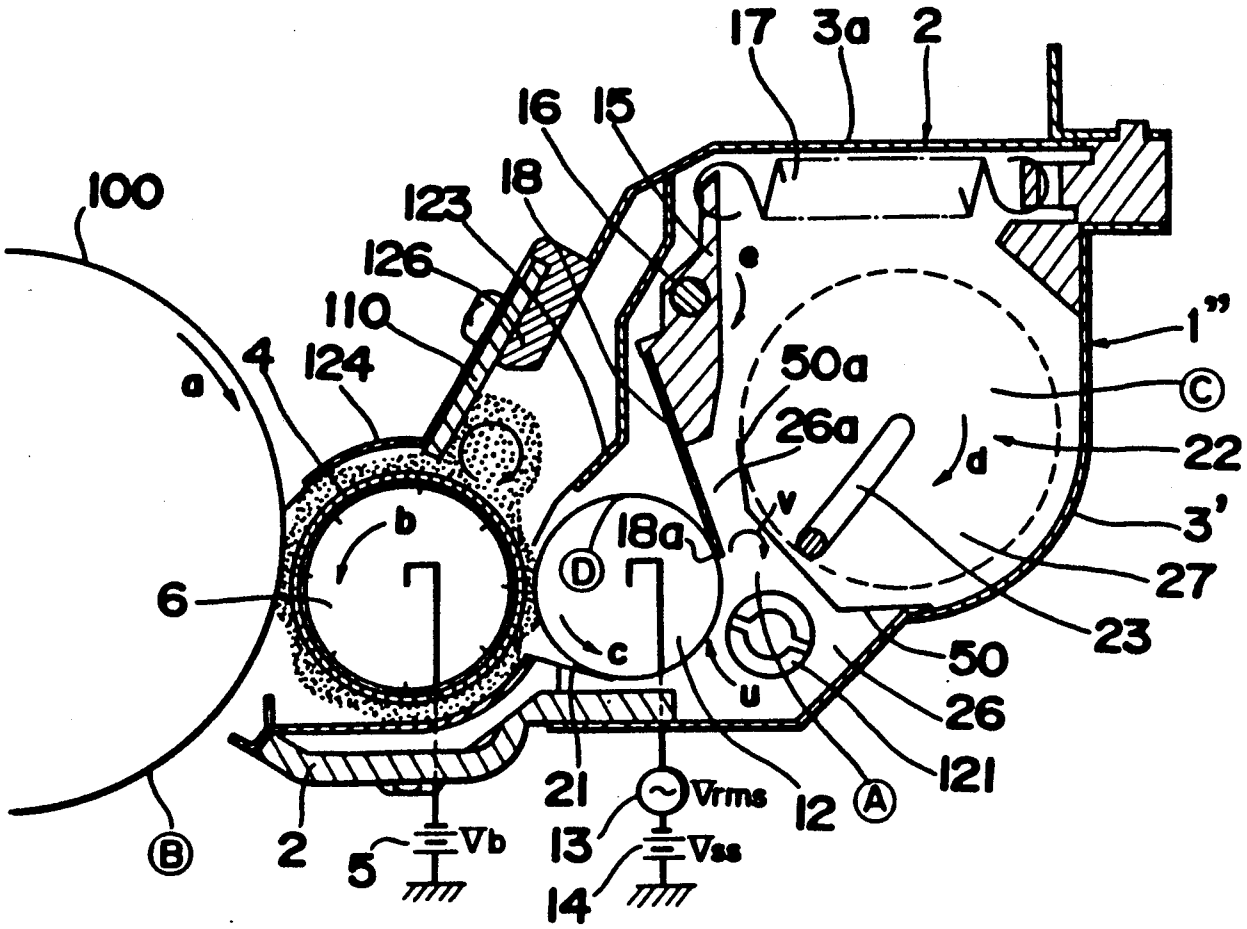
FIG. 18 is a sectional view showing an electrostatic latent image developing apparatus according to a seventh embodiment of the present invention.

The seventh embodiment shown in FIG. 18 employs a monocomponent developing material as in the developing apparatus 30 of the foregoing embodiment. In this embodiment, reference numeral 123 denotes a partition member, extending from the developing tank 2 to the confronting portion between the developing sleeve 4 and the toner supplying roller 12. The lower portion of the partition wall 50 is fixed to the casing 3 and the upper portion **50*a* thereof is positioned over the end 18*a* of the blade 18. Within the supply chamber 26, the agitating member 23 is arranged to be rotatable in the direction indicated by an arrow d, so that the agitating member pushes the toner held in the supply chamber 26 out to the outer peripheral surface of the toner supplying roller 12** in order to prevent cohesion of the regulated toner and supplied fresh toner.

According to the above construction of the developing apparatus 1'', toner held in the supply chamber 26 is transported to the outer peripheral portion of the toner supplying roller 12, based on rotation of an agitating member 121 in the direction indicated by an arrow U. Toner positioned near the outer peripheral portion of the toner supplying roller 12 is transported in the direction indicated by an arrow c, based on the rotation of the roller 12, and is regulated by the end **18*a* of the blade 18. Then, only toner taken into the minute irregularities on the surface of the roller 12 is passed near the end 18*a* of the blade 18 and is transported to the confronting portion with respect to the developing sleeve 4** to develop the image in the above-described manner.

Meanwhile, toner scraped off the surface of the toner supplying roller 12 is transported in the direction indicated by an arrow V, while forming a vortex by regulation of the partition wall 50. Then, the toner is circulated in the supply chamber 26 along the toner flow based on rotation of the agitating member 121, and the same toner is held onto the outer peripheral portion of the surface of the toner supplying roller 12 again. Some of that toner is supplied thereto to develop, and some others of the toner is circulated in the supply chamber 26 again. Therefore, toner scraped off can not be entered into the supplementary chamber 27 because of the presence of the partition wall 50.

In the above movement, selection of toner grain diameter is carried out by the end **18*a* of the blade 18, and thus the average grain diameter of toner held in the supply chamber 26** becomes bigger because toner having smaller grain diameter is preferably consumed.

However, at the same time as the average grain diameter of toner held in the supply chamber 26 becomes bigger, the average grain diameter of toner passed near the end **18*a* of the blade 18 also becomes bigger. When, finally, the average grain diameter of toner passed therethrough for development becomes the same value as that of toner supplied from the supplementary chamber 27, the value of the average grain diameter of toner inserted into the supply chamber 26 balances with that of toner supplied therefrom and thus, reaches a stable state. Namely, toner having the average grain diameter and inserted into the supplementary chamber 27** is used for development.

Next, toner having the average grain diameter 14 μm is inserted into the toner accommodating tank 22 of the developing apparatus 1'' shown in FIG. 18 and the measurement of the average grain diameter of toner, in relation to the number of copied sheets, at the measured point B, C, D and the measured point A positioned in the supplementary chamber 27 was carried out.

Figure 19:
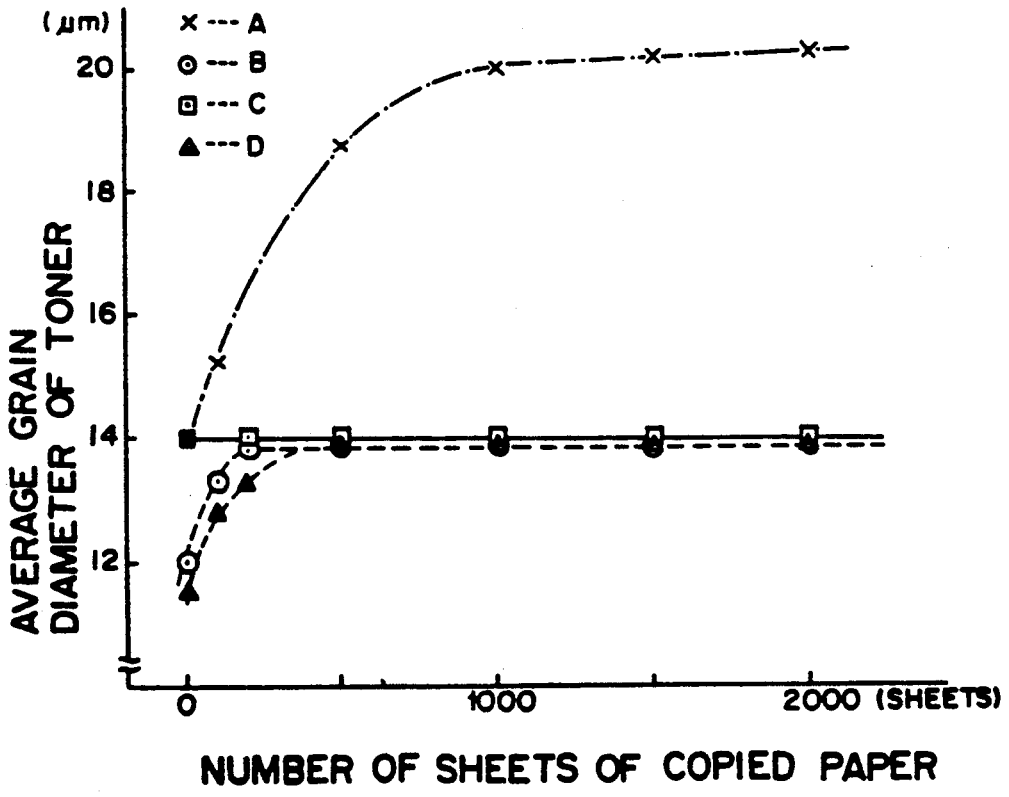
FIG. 19 is a graph illustrating the relation between the number of sheets of copied paper and the average grain diameter of toner, according to the apparatus described in FIG. 18.

The results shown in FIG. 19 are obtained from such measurement. Namely, at the measured point A, the diameter becomes bigger and bigger since copying operation starts, and the diameter is about 20 μm in a stable state after the number of copied sheets exceeds 1000 sheets.

At the measured point D, located on the surface of the toner supplying roller 12 and passed near the end 18*a* of the blade 18, and the measured point B located on the surface of the photosensitive drum 100, the average grain diameter of toner is 12 μm or less initially and becomes bigger and bigger until it reaches about 14 μm after the number of copied sheets reaches 200–300 sheets and is maintained at that value.

Furthermore, at measured point C located in the supplementary chamber 27, the diameter is maintained at the value of the insert average grain diameter 14 μm because toner does not flow backward from the supply chamber 26. The copied image is in a stable state and no abnormality such as fog of the copied image was recognized regardless of the number of copied sheets.

In the foregoing embodiments, the dimension of the space between the blade 18 and the partition wall 50 is nearly equal to the diameter of the vortex, rotating in the direction indicated by an arrow V, formed by toner regulated by the blade 18 and is, preferably, about 5–20 mm, though the dimension depends on the size of the developing apparatus 1".

It is necessary for the set angle of the blade 18 to set a suitable value so that while toner regulated by the blade is carried thereon, the movement of toner is influenced by the contact pressure. The set value ranges, preferably, within ±60° to the vertical direction.

It is necessary for the arrangement of the end 18*a* of the blade 19 and the agitating member 121 to be set so that toner regulated by the blade 18 is taken into the toner flow formed by rotation of the agitating member 121.

Furthermore, it is to be noted that, although in the foregoing embodiments the agitating member is provided in the supply chamber 26, it is not necessary to provide it therein if toner can be moved toward the toner supplying roller 12 by changing the shape of the developing tank 2. If the agitating member is provided therein, toner is positively pushed out to the toner supplying roller 12 and such an apparatus is advantageous in that the toner holding capacity of the toner supplying roller 12 is further improved.

EIGHTH EMBODIMENT

Figure 20:
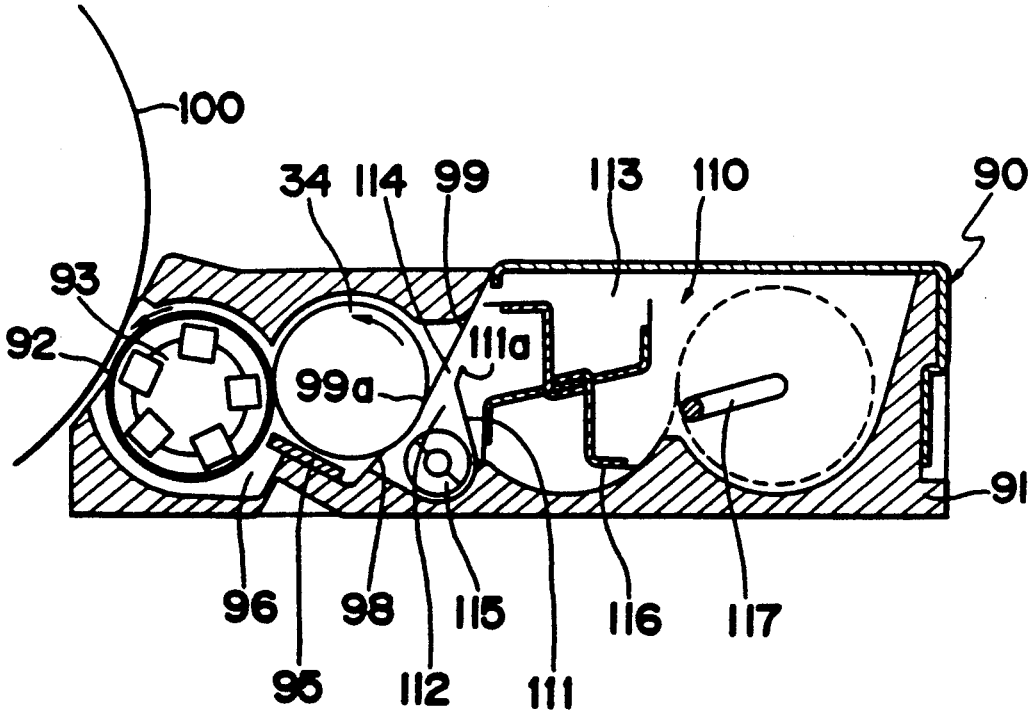
FIG. 20 is a sectional view showing an electrostatic latent image developing apparatus according to an eighth embodiment of the present invention.

The present invention can be applied to another embodiment, that is, the apparatus shown in FIG. 20.

In this developing apparatus 90, a developing sleeve 92 provided with a magnetic roller 93 is arranged at the front portion of a developing tank 91 and the toner supplying roller 34 having minute irregularities on the outer peripheral surface thereof is arranged therebehind to confront thereto. A regulating blade 99 is attached along the up-and-down direction to the tank 91, and a toner returning prevention member 98 contacts the surface of the toner supplying roller 34 and by this arrangement, a toner hopper 110 is formed therebehind. A partition wall 111 attached to the bottom of a toner hopper 110 is arranged upwardly at the front of the toner hopper 110. The inner space of the toner hopper 110 is partitioned into a supply chamber 112 and a supplementary chamber 113 and both chambers are connected to each other through the upper opening 114 of the supply chamber 112. The upper end 111*a* of the partition wall 111 is positioned above the end 99*a* of the blade 99. In the supply chamber 112, an agitating member 115 is provided and in the supplementary chamber 113, agitating blades 116 and 117 are provided.

According to the construction of the developing apparatus 90, based on rotation of the agitating blades 116 and 117, toner held in the supplementary chamber 113 is transported forwardly. Toner held in the supply chamber 112 is pushed out therefrom to the outer peripheral surface of the toner supplying roller 34, based on rotation of the agitating member 115. Toner held near the outer peripheral portion of the surface of the roller 34 is transported according to rotation thereof, and is regulated by the end 99*a* of the blade 99. Toner passed here is taken into the carrier on the surface of the developing sleeve 92 and is mixed and agitated with the carrier on the surface of the sleeve 92 so that they are supplied for development. Toner regulated by the blade 99 is transported while circulating in the supply chamber 112, according to regulation of the partition wall 111, and thus toner is supplied for development after passing near the end 99*a* of the blade 99. Under this state, selection of toner grain diameter is carried out by the end 99*a* of the blade 99, and then for development toner having smaller grain diameter is preferably supplied. Thus, the average grain diameter of toner held in the supply chamber 112 becomes bigger and bigger. However, as the average grain diameter of toner becomes bigger, the average grain diameter thereof is equal to that transported from the supplementary chamber 113, both the average grain diameter of toner inserted into the supply chamber 112 and that of toner transported therefrom for development are in a stable state. Thus, toner held in the supplementary chamber 113 is supplied for development.

NINTH EMBODIMENT

Figure 21:
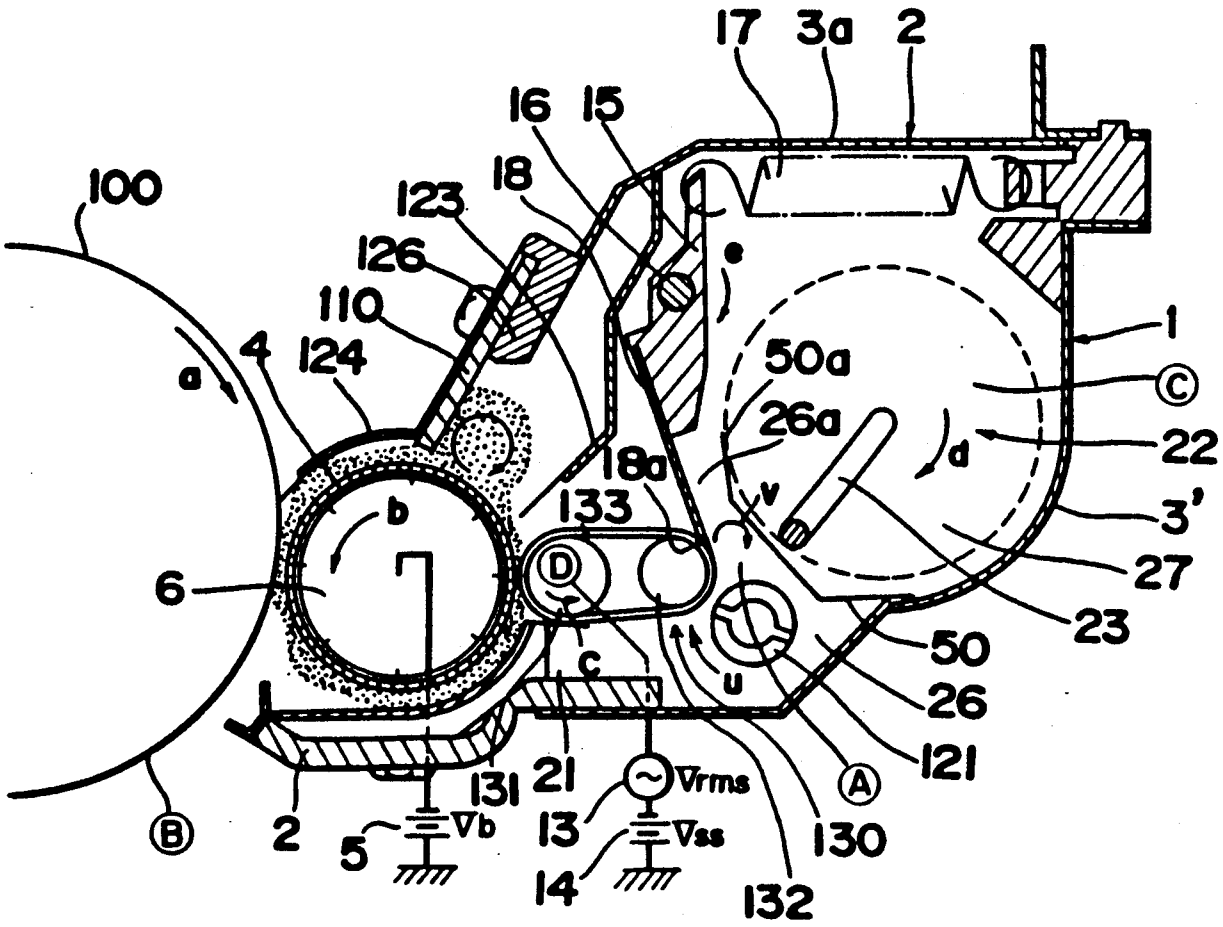
FIG. 21 is a sectional view showing an electrostatic latent image developing apparatus according to a ninth embodiment of the present invention.

It should be noted that, although the foregoing embodiments have been mainly described with reference to the developing apparatus being provided with a toner supplying roller, the present invention is not limited in the foregoing embodiments, but can be readily applied to a developing apparatus being provided with a conveyor-belt-type toner holding member 130, as shown in FIG. 21. The member 130 comprises two rollers 131 and 132 and a belt 133 connected to the rollers 131 and 132. The belt 133 is preferably formed by an electrically conductive non-magnetic material, e.g., aluminum or the like.

Furthermore, it should be noted that, although the seventh and eighth embodiments have been mainly described with reference to the developing apparatus employing the two-component developing material, they can be readily applied to a developing apparatus using a mono-component developing material.

It is preferable that one of the toner supplying roller and the blade is made of elastic material so as to form a uniformly thin toner layer on the surface thereof when the roller and the blade get run in.

It is to be noted that although the foregoing embodiments have been mainly described with reference to the copying machine which the developing apparatus according to the present invention is applied to, the apparatus can be applied to an image-forming-apparatus, such as, for example, a printer, e.g., a reader printer.

As is clear from the foregoing description, in the developing apparatus according to the above embodiments of the present invention, there is provided a partition wall arranged in the toner accommodating tank or the toner hopper, so that based on rotation of the toner supplying roller, toner scraped off from the surface of the roller by the blade is collected into the supply chamber so as not to enter into the supplementary chamber formed behind the partition wall and to supply toner to the small chamber which has an insert average grain diameter which the toner had when the toner was inserted into the toner accommodating tank or the toner hopper.

Therefore, if, in the supply chamber, the average grain diameter of the toner becomes bigger, as toner corresponding to the amount of consumed toner and having the insert average grain diameter is supplied thereto, toner having the insert average grain diameter is supplied in a stable manner for development and thus the fine texture and nonfoginess, that is, good quality, of the image can be obtained.

It is to be noted that when the developing apparatus is removed from the copying machine body in the non-copying operation, or when trouble such as blockage of a passage with paper is caused, the supply chamber is shut by the shutter so as not to connect with the supplementary chamber and so as to prevent mixing and agitation of the toner held in both chambers. Then, the average grain diameter of toner held in the supply chamber can maintain a stable and specified value.

Although the present invention has been fully described by way of example with reference to the accompanying drawings, it is to be noted here that various changes and modifications will be apparent to those skilled in the art. Therefore, unless such changes and modifications depart from the scope of the present invention, they should be construed as being included therein.

What is claimed is:

1. A developing apparatus comprising: a toner hopper in which is positioned an agitating member, a rotatably driven toner holding member arranged at an opening of said toner hopper, a regulating member contacting said toner holding member under pressure, toner held in said toner hopper being transported by rotation of said toner holding member while said regulating member regulates the transport of said toner by removing excess toner from said toner holding member, said toner hopper including a small chamber positioned near said toner holding member and a supplementary chamber in which is located said agitating member, said supplementary chamber supplying toner to said small chamber, and partition means positioned between said small chamber and said supplementary chamber for permitting toner to be supplied from the supplementary chamber to the small chamber and for substantially preventing the excess toner removed by the regulating member from being returned from the small chamber to the supplementary chamber.

2. The developing apparatus according to claim 1, wherein said partition means is a partition wall integrally formed with and extending upwardly from a bottom of said toner hopper.

3. The developing apparatus according to claim 1, including a toner returning preventing member in contact with the toner holding member at a point downstream from the regulating member with respect to the direction of rotation of said toner holding member, said toner returning preventing member defining a boundary for the small chamber for preventing toner in the small chamber from moving beyond the point where the toner returning preventing member contacts the toner holding member.

4. A developing apparatus comprising: a toner hopper in which is positioned an agitating member, a rotatably driven toner holding member arranged at a front portion of said toner hopper, a regulating member arranged on an upper portion of said toner hopper, an end of said regulating member contacting an outer peripheral surface of said toner holding member, developing material held on the outer peripheral surface of said toner holding member being transported for development through rotation of said toner holding member while said regulating member regulates the transport of said developing material, and partition means positioned between said toner holding member and said agitating member at a bottom of said toner hopper for ensuring that developing material transported from the agitating member to the toner holding member is substantially prevented from being returned to the agitating member, said partition means extending upwardly from the bottom of said toner hopper so that an upper end portion of the partition means extends above the point where said regulating member contacts the outer peripheral surface of the toner holding member.

5. A developing apparatus as claimed in claim 4, wherein bias voltage of biased alternating current is impressed on said toner holding member.

6. The developing apparatus according to claim 4, wherein said partition means is a partition wall integrally formed with and extending upwardly from a bottom of said toner hopper.

7. A developing apparatus as claimed in claim 4, wherein said toner hopper includes a small chamber positioned near said toner holding member and a supplementary chamber in which is located said agitating member, said supplementary chamber supplying toner to said small chamber, and said partition means being positioned between said small chamber and said supplementary chamber.

8. The developing apparatus according to claim 7, including a toner returning preventing member in contact with the toner holding member at a point downstream from the regulating member with respect to the direction of rotation of said toner holding member, said toner returning preventing member defining a boundary for the small chamber for preventing toner in the small chamber from moving beyond the point where the toner returning preventing member contacts the toner holding member.

9. A developing apparatus as claimed in 1 or 4, wherein at least one of said toner holding member and said regulating member is made of elastic material.

10. A developing apparatus as claimed in claim 1 or 4, further comprising a photosensitive member confronting said toner holder member.

11. A developing apparatus as claimed in claim 1 or 4, wherein said toner holding member confronts said regulating member.

12. A developing apparatus as claimed in claims 1 or 7, wherein an agitating member is arranged in said small chamber.

13. A developing apparatus comprising:

a toner hopper, a rotatably driven toner holding member arranged at an opening of said toner hopper, a regulating member contacting said toner holding member under pressure, toner held on a surface of said toner holding member being transported for development by rotation of said toner holding member while said regulating member regulates the transport of said developer, partition means for partitioning said toner hopper into a small chamber and a supplementary chamber and for permitting toner to be supplied from the supplementary chamber to the small chamber and for substantially preventing the return of toner from the small chamber to the supplementary chamber, and a movable shutter positioned in said toner hopper between said small chamber and said supplementary chamber, said shutter being movable between an open position in which said small chamber is in communication with said supplementary chamber and a closed position in which said small chamber is substantially prevented from communicating with said supplementary chamber.

14. The developing apparatus according to claim 13, wherein said partition means is a partition wall integrally formed with and extending upwardly from a bottom of said toner hopper.

15. The developing apparatus according to claim 13, wherein said movable shutter is attached to said partition means.

16. The developing apparatus according to claim 13, including a toner returning preventing member in contact with the toner holding member at a point downstream from the regulating member with respect to the direction of rotation of said toner holding member, said toner returning preventing member defining a boundary for the small chamber for preventing toner in the small chamber from moving beyond the point where the toner returning preventing member contacts the toner holding member.

* * * * *